US006226477B1

(12) United States Patent
Kurosawa et al.

(10) Patent No.: US 6,226,477 B1
(45) Date of Patent: May 1, 2001

(54) TONER CARTRIDGE HAVING SEPARABLE PARTS AND RECORDING APPARATUS WITH TONER CARTRIDGE

(75) Inventors: Eiji Kurosawa, Ueda; Takashi Naito, Saku; Katsumi Yawata, Ueda, all of (JP)

(73) Assignee: Matsushita Graphic Communications Systems, Inc., Tokyo (JP)

( * ) Notice: Subject to any disclaimer, the term of this patent is extended or adjusted under 35 U.S.C. 154(b) by 0 days.

(21) Appl. No.: 09/475,660

(22) Filed: Dec. 30, 1999

(30) Foreign Application Priority Data

Apr. 12, 1999 (JP) ..... 11-103608

(51) Int. Cl.[7] ..... G03G 21/16
(52) U.S. Cl. ..... 399/111
(58) Field of Search ..... 399/107, 111, 399/112, 113, 116, 117, 159, 167, 125, 110

(56) References Cited

U.S. PATENT DOCUMENTS 6,029,031 * 2/2000 Yokomori et al. ..... 399/113 X

* cited by examiner

*Primary Examiner*—Sophia S. Chen
*Assistant Examiner*—Hoan Tran
(74) *Attorney, Agent, or Firm*—Greenblum & Bernstein, P.L.C.

(57) ABSTRACT

The toner cartridge includes a coupling plate provided with a first support section that supports the axis of a photosensitive drum and a seconds support section that supports the axis of the magnet roller. The toner cartridge mounts this coupling plate so that the first support section supports the axis of the photosensitive drum provided in a first part of the toner cartridge and the second support section supports the axis of the magnet roller provided in the second part of the toner cartridge, thus maintaining a predetermined distance between the axis of the photosensitive drum and the axis of the magnet roller.

14 Claims, 11 Drawing Sheets

TONER CARTRIDGE HAVING SEPARABLE PARTS AND RECORDING APPARATUS WITH TONER CARTRIDGE

BACKGROUND OF THE INVENTION

1. Field of the Invention

The present invention relates to a toner cartridge that can be used for an electrophotographic recording apparatus such as a facsimile apparatus, printer and copier.

2. Description of the Related Art

A recording apparatus equipped with a toner cartridge is known. A typical toner cartridge comprises a photosensitive drum, charger that uniformly charges the surface of the photosensitive drum, toner hopper that contains toner, magnet roller that provides toner for the surface of the photosensitive drum and waste toner unit that removes and collects the toner remaining on the surface of the photosensitive drum.

Recently, a toner cartridge is required to have a structure easy to be taken apart for refilling. To meet this requirement, the toner cartridge may be composed of two separable parts. Such a toner cartridge can be taken apart into a part including the toner hopper and the other including the waste toner unit. The photosensitive drum and magnet roller are placed in either the part including the toner hopper or the other including the waste toner unit.

There is no problem if the photosensitive drum and magnet roller belong to the same part. However, a problem arises when the photosensitive drum and magnet roller belong to different parts. This is because both sections in this structure become easily separable from each other. Since the photosensitive drum should maintain a certain distance from the magnet roller, the recording performance deteriorates if the distance between the photosensitive drum and the magnet roller is not constant.

SUMMARY OF THE INVENTION

The present invention has been implemented taking the problem above into account and it is an objective of the present invention to provide a toner cartridge that can maintain the distance between the photosensitive drum and magnet roller constant and achieve high recording performance while having a structure easy to be taken apart.

In order to solve the conventional problem described above, the present invention provides a coupling section comprising a first support section that supports the axis of the photosensitive drum and a second support section that supports the axis of the magnet roller and mounts this coupling section in such a way that the first support section supports the axis of the photosensitive drum provided in the first part and the second support section supports the axis of the magnet roller provided in the second part, thus providing a configuration to maintain a predetermined distance between the axis of the photosensitive drum and the axis of the magnet roller.

Since the coupling section can maintain a predetermined distance between the axis of the photosensitive drum and the axis of the magnet roller, the distance between the photosensitive drum and the magnet roller never changes during a recording operation and it is always possible to maintain optimal recording. Moreover, the present invention eliminates the need to design so that both sections come closer to each other according to the load on the gear, thus simplifying the gear configuration of the recording apparatus, which will reduce the size of the recording apparatus.

A first embodiment of the present invention is a toner cartridge comprising a first part containing a photosensitive drum that retains an electrostatic latent image to be developed on the surface and a second part containing a magnet roller that supplies toner in the toner hopper to the photosensitive drum and develops the electrostatic latent image, further comprising a coupling section made up a first support section that supports the axis of the photosensitive drum and a second support section that supports the axis of the magnet roller, and mounting this coupling section in such a way that the first support section supports the axis of the photosensitive drum and the second support section supports the axis of the magnet roller, thus maintaining a predetermined distance between the axis of the photosensitive drum and the axis of the magnet roller.

Since the coupling section can maintain a predetermined distance between the axis of the photosensitive drum and the axis of the magnet roller, the distance between the photosensitive drum and the magnet roller can always be kept constant even if the photosensitive drum and magnet roller are placed in different parts, preventing the recording performance from deteriorating.

Another embodiment of the present invention couples the first part containing the photosensitive drum above and the second part containing the magnet roller in a pivotable manner centered on a fulcrum at a position apart from the axial lines of the photosensitive drum and magnet roller and maintains a predetermined distance between the photosensitive drum and magnet roller by means of the coupling section.

If the first part and second part are coupled in a pivotable manner in this way, the photosensitive drum and magnet roller can come closer to each other up to a predetermined distance by rotating the first and second parts, and the first part and second part can be coupled by coupling the axis of the photosensitive drum and the axis of the magnet roller in this position by means of the coupling section, thus allowing the toner cartridge to be assembled easily.

Another embodiment of the present invention has a configuration with the first support section of the coupling section held in a through hole formed in a side plate of the first part in a pivotable manner and the second support section that can be engaged with the axis of the magnet roller by rotating the coupling section with the first support section inserted and kept in the through hole.

This configuration allows the coupling section to be attached to the side plate by inserting the first support section into the through hole of the side plate of the first part, then allows the second support section to be engaged with the axis of the magnet roller and held by making the first support section support the photosensitive drum and by making the magnet roller come closer to the photosensitive drum up to a predetermined distance and then rotating the coupling section, thus making easier an assembly operation to couple the two separated parts.

Another embodiment of the present invention has such a configuration allowing the first support section of the coupling section to be inserted into the through hole formed in the side plate of the first part from the outer surface of the side plate at a predetermined rotation angle and preventing the first support section from coming off by rotating the coupling section a little further from the position, and allowing the second support section to be engaged with the axis of the magnet roller by rotating the coupling section with the first support section inserted in the through hole, and further providing a provisional stopper mechanism for the first part and the coupling section to temporarily prevent the rotation of the coupling section that is rotating in the direction to engage with the magnet roller.

This configuration allows the toner cartridge to be assembled by mounting the coupling section by inserting its first support section into the through hole in the side plate of the first part and making the first support section support the photosensitive drum, then rotating this coupling section up to a position where the rotation of the coupling section is regulated by the provisional stopper section, which prevents the first support section from coming off from the side plate and further prevents the coupling section and the photosensitive drum supported thereby from coming off from the first part, thus making it easy to handle the first part. Then, it is possible to engage the second support section with the axis of the magnet roller and easily perform an assembly operation coupling the two separated parts by incorporating the second part with predetermined parts assembled in the first part, making the magnet roller come closer to the photosensitive drum up to a predetermined distance and then rotating the coupling section further from the position regulated by the provisional stopper section.

Another embodiment of the present invention further provides the first part and coupling section with a stopper mechanism that prevents the coupling section from rotating in reverse direction after the coupling section is rotated up to a position where the second support section engages with the axis of the magnet roller.

This configuration prevents the coupling section that couples the photosensitive drum with the magnet roller from rotating unnecessarily and coming off from the magnet roller, making it possible to use the coupling section stably all the time.

BRIEF DESCRIPTION OF THE DRAWINGS

The above and other objects and features of the invention will appear more fully hereinafter from a consideration of the following description taken in connection with the accompanying drawing wherein one example is illustrated by way of example, in which.

DETAILED DESCRIPTION OF THE PREFERRED EMBODIMENTS

Figure 1:
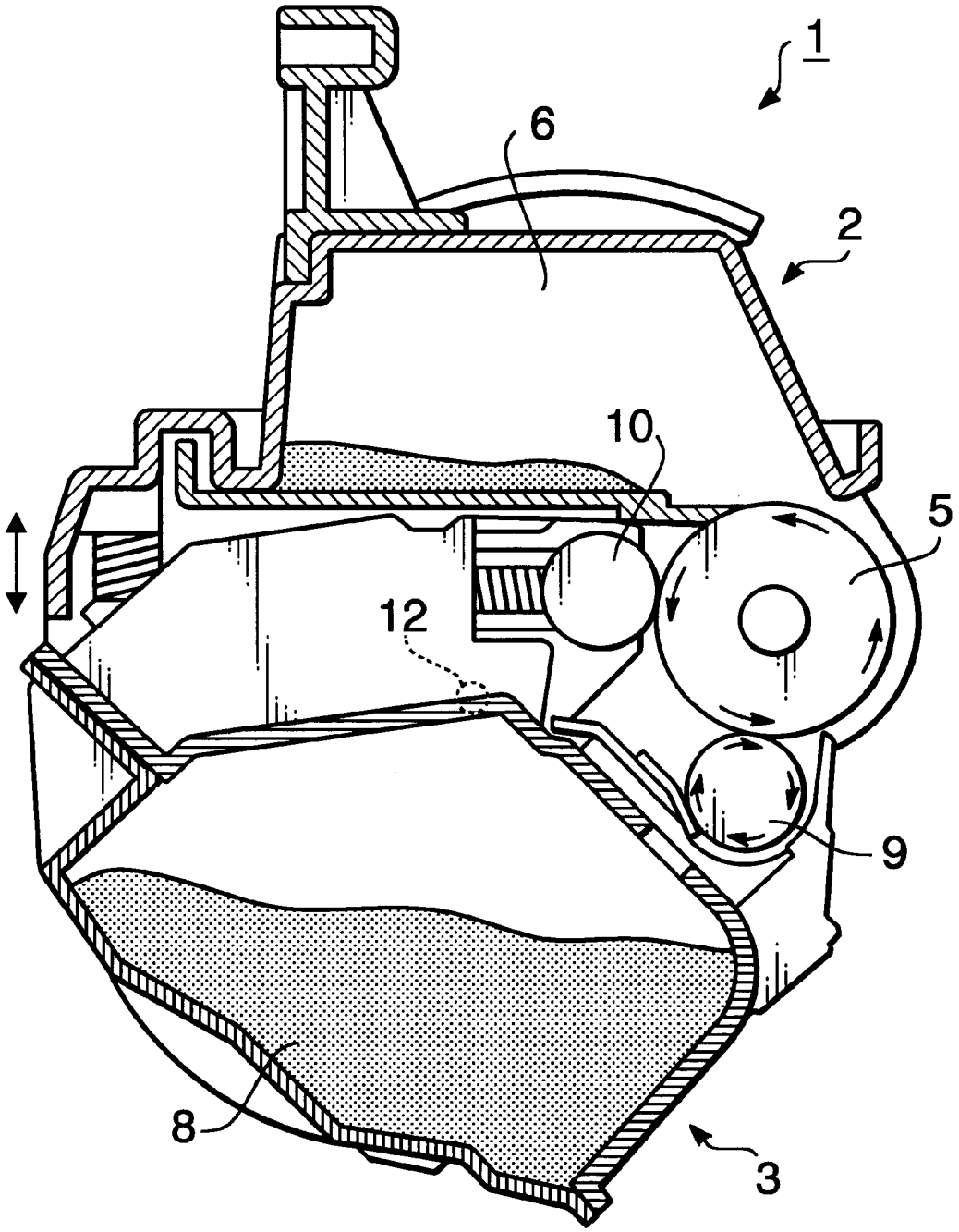
FIG. 1 is an outlined cross-sectional view of a toner cartridge according to an embodiment of the present invention.
Figure 2:
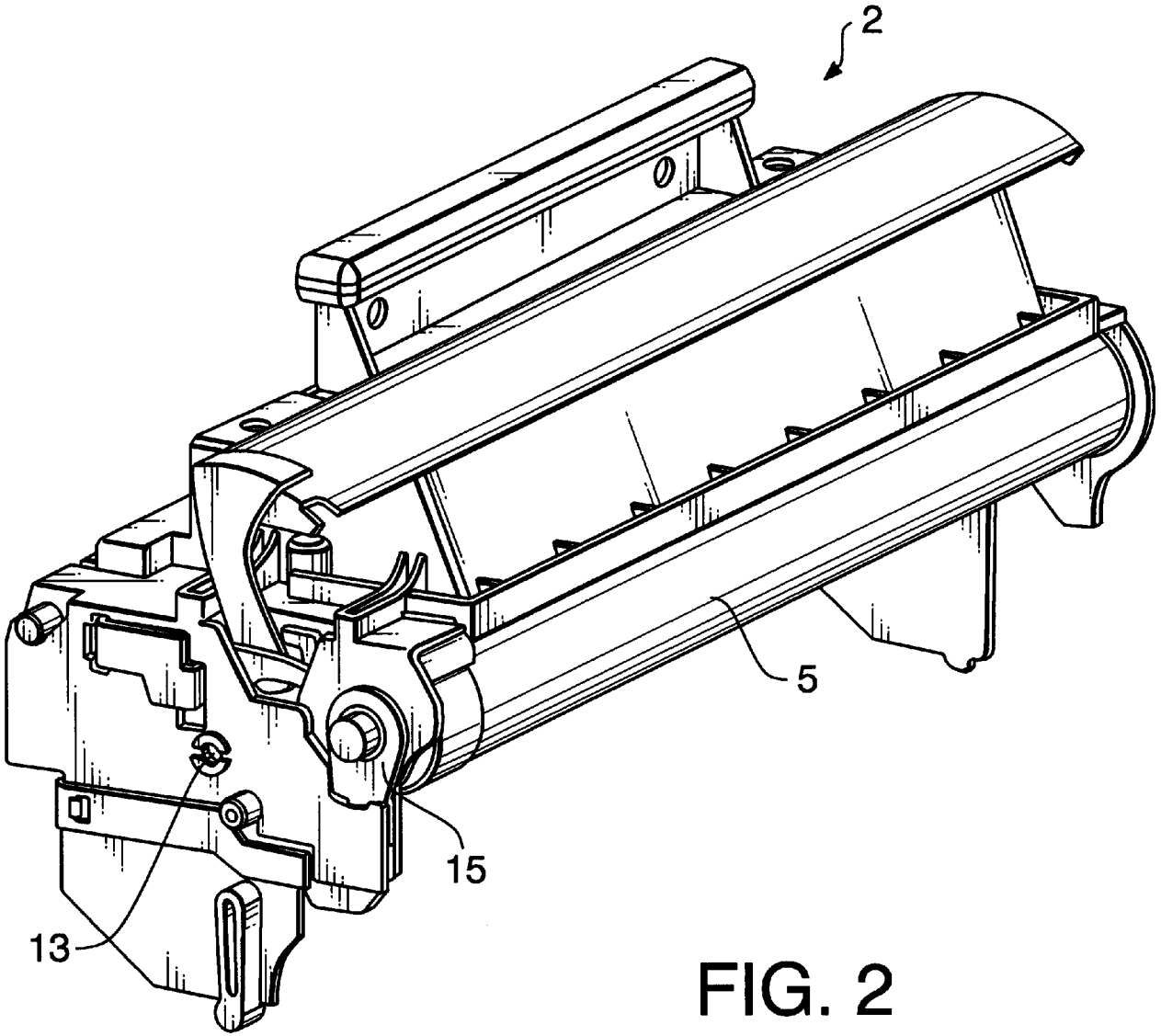
FIG. 2 is an outlined perspective view showing a first part of the toner cartridge in FIG. 1.
Figure 3:
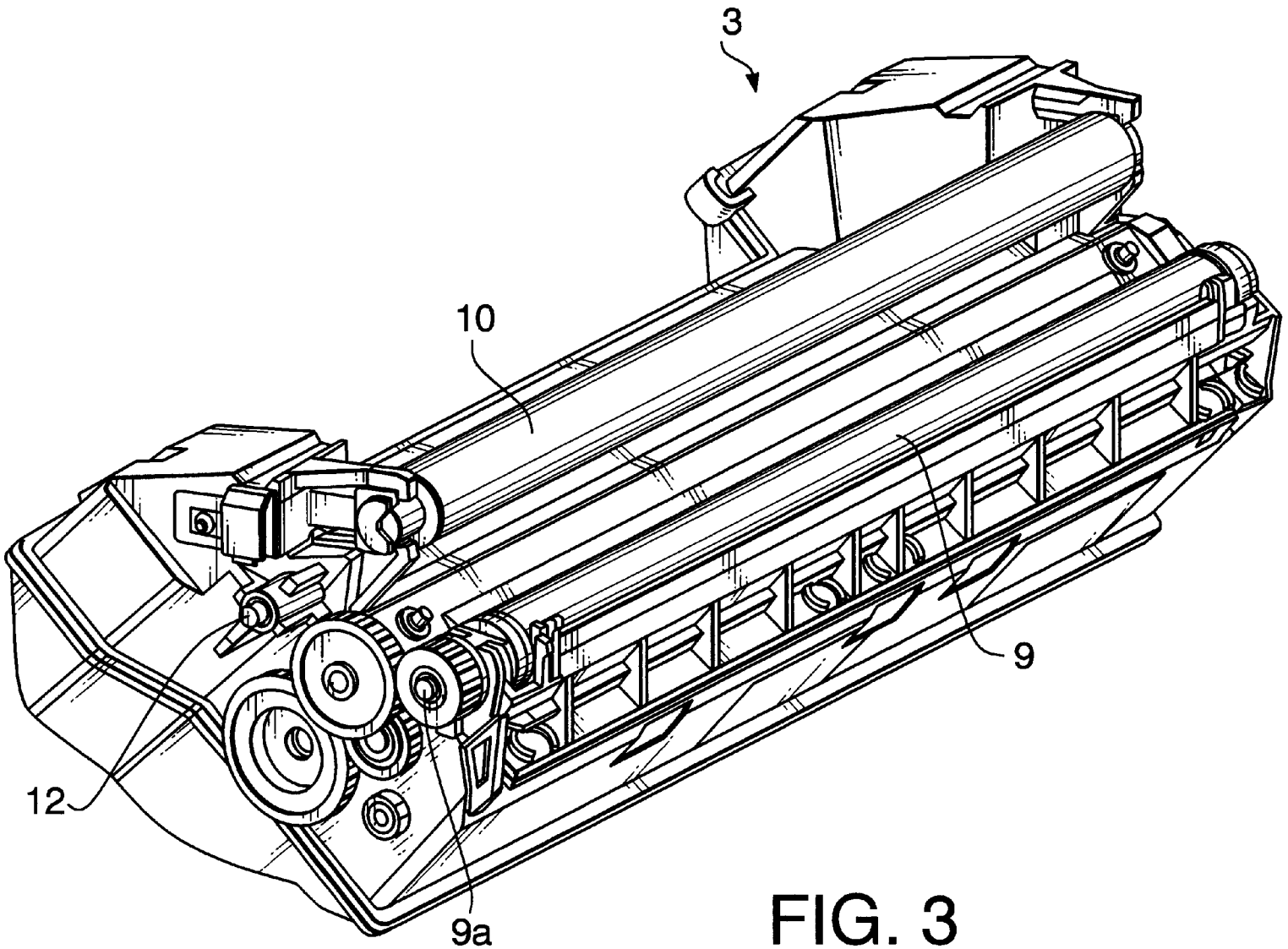
FIG. 3 is an outlined perspective view showing a second part of the toner cartridge in FIG. 1.
Figure 4A:
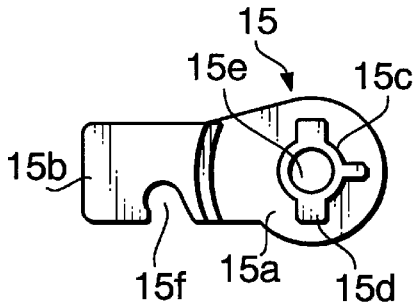
FIG. 4A is a floor plan showing a coupling plate that mechanically couples the rotation axes of a photosensitive drum and magnet roller.
Figure 4B:
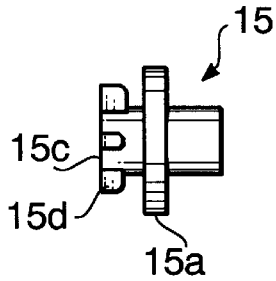
FIG. 4B is an end face view showing the coupling plate that mechanically couples the rotation axes of the photosensitive drum and magnet roller.
Figure 4C:
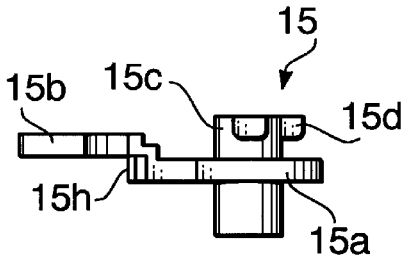
FIG. 4C is a side view showing the coupling plate that mechanically couples the rotation axes of the photosensitive drum and magnet roller.
Figure 4D:
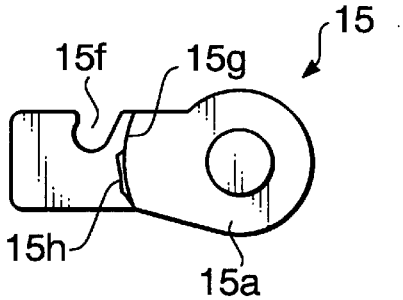
FIG. 4D is a floor plan showing the coupling plate that mechanically couples the rotation axes of the photosensitive drum and magnet roller.
Figure 4E:
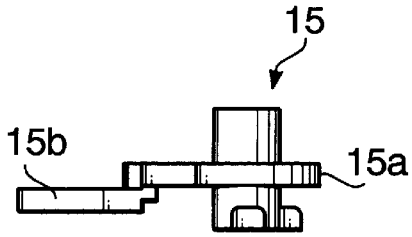
FIG. 4E is a side view showing the coupling plate that mechanically couples the rotation axes of the photosensitive drum and magnet roller.

With reference now to the attached drawings, the embodiments of the present invention are explained below. FIG.1 is an outlined cross-sectional view of a toner cartridge according to an embodiment of the present invention. FIG. 2 is an outlined perspective view showing a first part of the toner cartridge. FIG. 3 is an outlined perspective view showing a second part of the toner cartridge. Toner cartridge 1 is composed of first part 2 and second part 3, which are separable from each other.

First part 2 has photosensitive drum 5 that retains an electrostatic latent image on its surface and waste toner unit 6 that removes and collects toner remaining on the surface of photosensitive drum 5.

Second part 3 has toner hopper 8 that contains toner, magnet roller 9 that supplies toner in toner hopper 8 to photosensitive drum 5 and develops the electrostatic latent image and charging roller 10 that uniformly charges the surface of photosensitive drum 5, etc.

Toner cartridge 1 is assembled from first part 2 and second part 3 in such a way that the distance between photosensitive drum 5 and magnet roller 9 is kept constant. In order to assemble first part 2 and second part 3 in a predetermined positional relationship, first part 2 and second part 3 have structures as shown below:

The side walls of second part 3 are provided with pins 12, and first part 2 is formed pin holes 13 at the corresponding positions to allow pins 12 to be inserted to the corresponding pin hole 13. These pins 12 and pin holes 13 are located at positions apart from the axial lines of photosensitive drum 5 and magnet roller 9. Therefore, fitting pins 12 into pin holes 13 couples first part 2 with second part 3 in a pivotable manner centered on pins 12 as fulcrums. In this state, the distance between photosensitive drum 5 and magnet roller 9 can be changed freely.

Figure 5:
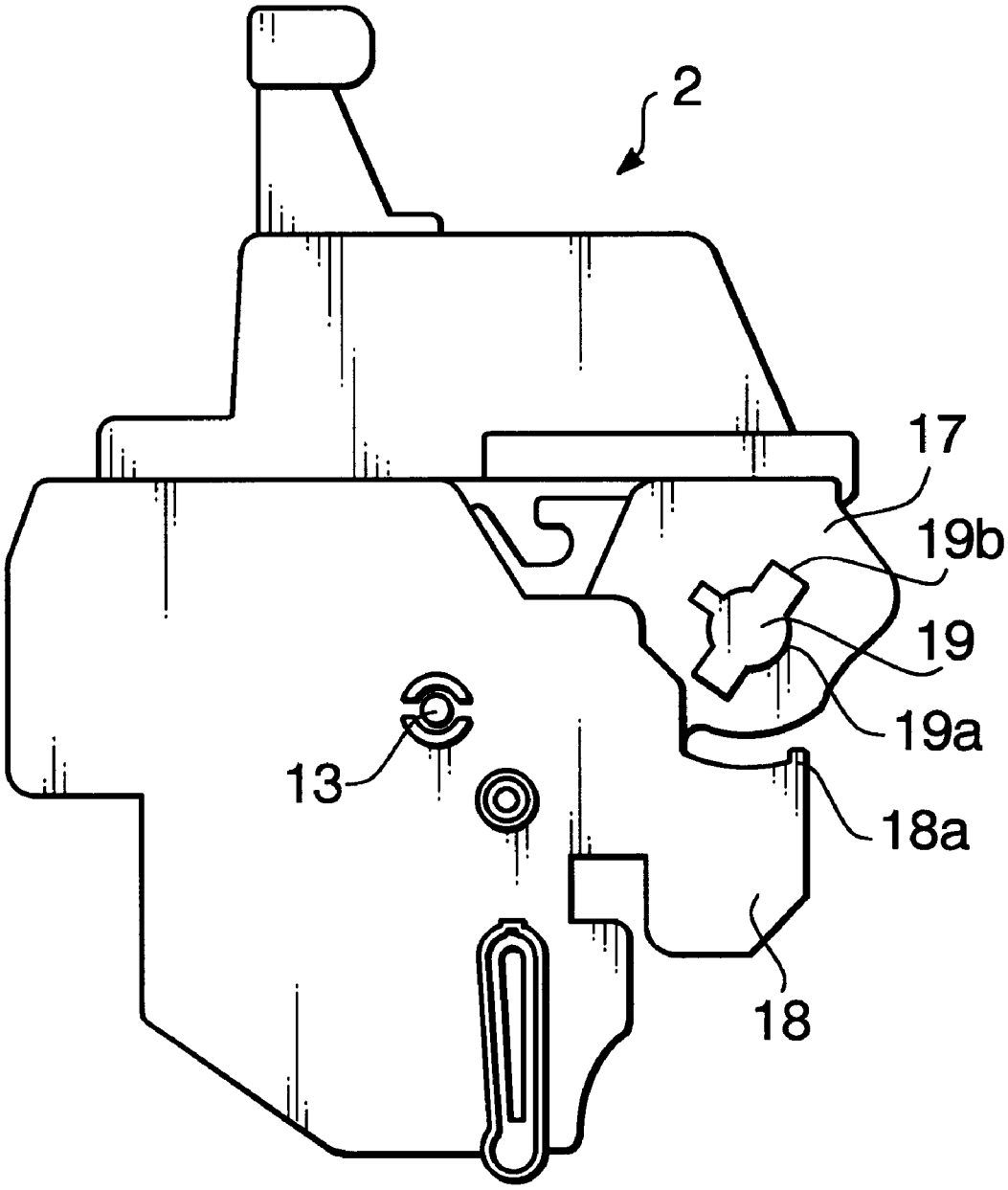
FIG. 5 is an outlined side view of the first part on the coupling plate side.
Figure 6C:
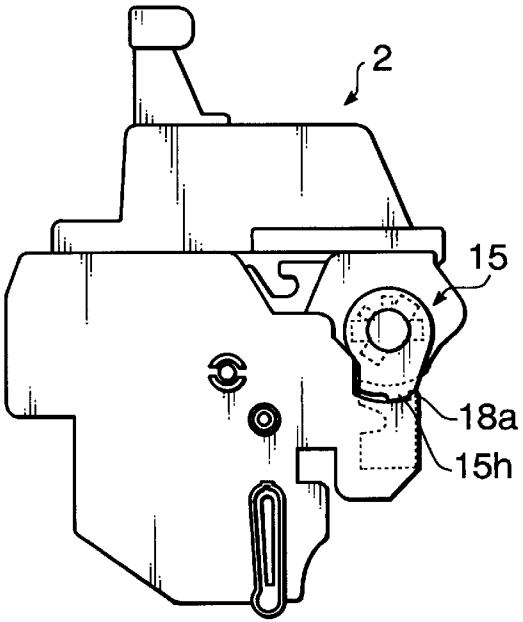
FIG. 6C is an outlined side view of the first part in state the that the coupling plate rotated up to the final position.
Figure 6B:
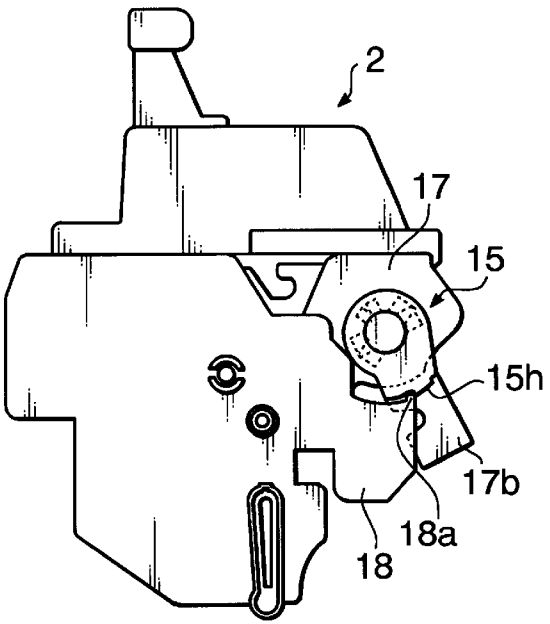
FIG. 6B is an outlined side view of the first part in state that the coupling plate rotated up to a provisionary stopping position.
Figure 6A:
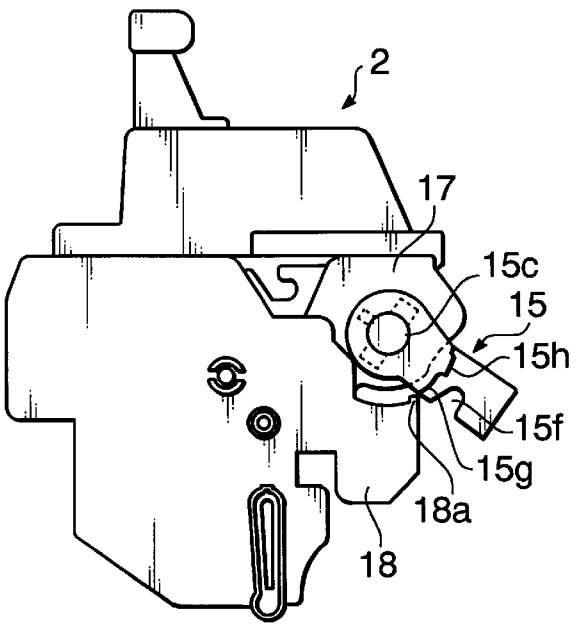
FIG. 6A is an outlined side view of the first part attached the coupling plate to the side wall.
Figure 7:
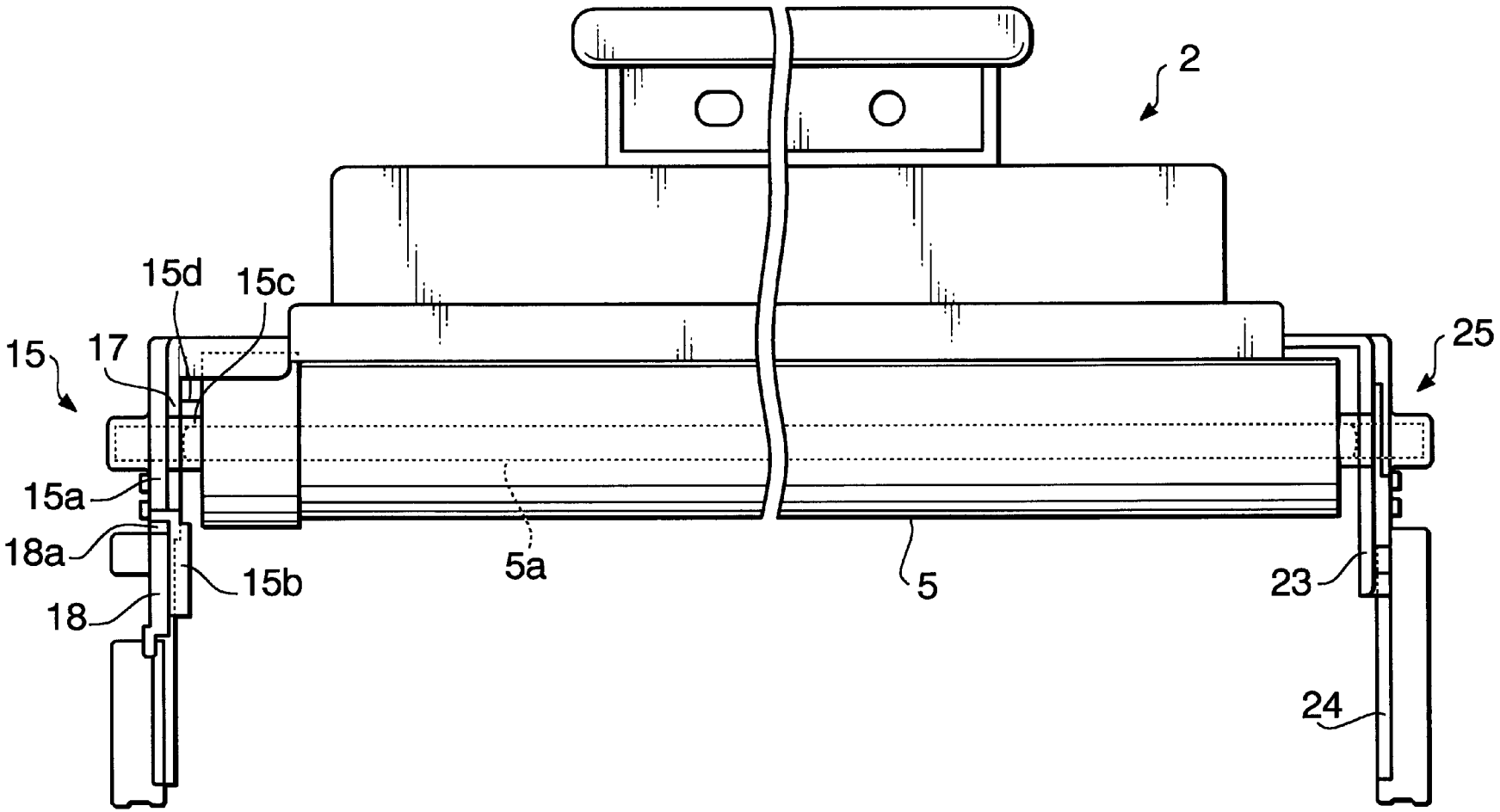
FIG. 7 is an outlined front view showing the photosensitive drum set in the first part.

Toner cartridge 1 is provided with coupling plate 15 to maintain a predetermined distance between photosensitive drum 5 and magnet roller 9. Now, the coupling structure of photosensitive drum 5 and magnet roller 9 using coupling plate 15 will be explained. FIGS. 4A–4E show coupling plate 15, FIG. 5 is an outline side view of first part 2, FIGS. 6A, 6B and 6C are outline side views showing first part 2 with coupling plate 15 attached and rotated and FIG. 7 is an outline front view of first part 2.

Coupling plate 15 has a solid structure made of resin, etc. and is made up of first flat section 15*a* and second flat section 15*b*. Second flat section 15*b* is formed one step higher than first flat section 15*a*.

First support section 15*c* that supports one end of the axis of photosensitive drum 5 is formed integral with first flat section 15*a*. First support section 15*c* has a cylindrical form and is provided with stopper protrusion 15*d* on the circumferential surface of its end and axis supporting hole 15*e* at the center into which axis 5*a* of photosensitive drum 5 is inserted.

Second support section 15*f* that engages with the axis of magnet roller 9 is formed in second flat section 15*b*. Second support section 15*f* has a U-figure shaved groove along circumferential direction when coupling plate 15 rotates around axis supporting hole 15*e*.

The distance between first support section 15*c* and second support section 15*f* is determined so as to maintain a predetermined distance between photosensitive drum 5 and magnet roller 9 to perform optimal development. Furthermore, first flat section 15*a* has arc guide plane 15*g* and arc provisional stopper protrusion 15*h* that protrudes a little from guide plane 15*g* at the end.

As is clear from FIG. 5 and FIG. 7, first side plate 17 and second side plate 18 are provided on one side wall of first part 2, and second side plate 18 is placed a little outward from first side plate 17. Through hole 19 is formed on first side plate 17 to attach coupling plate 15. This through hole 19 is provided with circular section 19*a* to pass the cylindrical section of first support section 15*c* of coupling plate 15 and groove 19*b* to pass stopper protrusion 15*d*. Therefore, when coupling plate 15 is placed at a rotation angle with respect to through hole 19 at which stopper protrusion 15*d* fits in groove 19*b*, first support section 15*c* can be inserted from the outer surface of side plate 17. After the insertion, rotating coupling plate 15 allows stopper protrusion 15*d* to get caught in the back side of side plate 17, preventing coupling plate 15 from coming off.

Moreover, as is clear from FIG. 7, when first support section 15*c* of coupling plate 15 is inserted into through hole 19 of first side plate 17, second flat section 15*b* of coupling plate 15 is designed to come more inwardly than second side plate 18 of first part 2 with respect to the axial direction of photosensitive drum 5. In FIG. 5, hook 18*a* is formed at the top of the right end of second side plate 18. As shown in FIG. 6, guide plane 15*g* of coupling plate 15 slides on the top of the right end of second side plate 18 and provisional stopper protrusion 15*h* collides with hook 18*a* stopping the rotation of coupling plate 15. The height of provisional stopper protrusion 15*h* is selected so that forcibly pressing coupling plate 15 allows coupling plate 15 to pass over hook 18*a*.

Here, the direction of through hole 19 formed in first side plate 17 is determined so that as shown in FIG. 6A, first support section 15*c* of coupling plate 15 can be inserted into through hole 19 when coupling plate 15 is at a rotation angle position (hereinafter referred to as "mounting position") at which coupling plate 15 is located a little above hook 18*a*. Furthermore, the opening direction of groove-figured second support section 15*f* formed in coupling plate 15 is determined so that when coupling plate 15 is rotated downward from the mounting position, coupling plate 15 can be engaged with axis 9*a* (see FIG. 8) of magnet roller 9 that is waiting at a predetermined position. Furthermore, regarding guide plane 15*g* of coupling plate 15, provisional stopper protrusion 15*h* and hook 18*a* of second side plate 18, when coupling 15 is rotated from the initial mounting position downward, hook 18*a* slides on guide plane 15*g*, and as shown in FIG. 6B, part of second flat section 15*b* comes behind second side plate 18, but before second support section 15*f* engages with the axis of the magnet roller, hook 18*a* collides with one end of provisional stopper protrusion 15*h*, stopping the rotation temporarily. Forcibly rotating coupling plate 15 further allows provisional stopper protrusion 15*h* to pass over hook 18*a* and when coupling plate 15 is rotated up to the position at which coupling plate 15 engages with the axis of the magnet roller as shown in FIG. 6C, hook 18*a* engages with the rear edge of provisional stopper protrusion 15*h*. Engagement of hook 18*a* with the rear edge of provisional stopper protrusion 15*h* prevents coupling plate 15 from rotating in the original direction.

As shown above, provisional stopper protrusion 15*h* and hook 18*a* constitute a provisional stopping means to temporarily stop the rotation of coupling plate 15 that is rotating in the direction coupling plate 15 engages with the axis of magnet roller 9. Moreover, after coupling plate 15 has rotated up to the position at which second support section 15*f* engages with the axis of magnet roller 9, provisional stopper protrusion 15*h* and hook 18*a* also work together as a stopper means to prevent coupling plate 15 from rotating in the reverse direction.

Here, as shown in FIG. 6B, when coupling plate 15 is temporarily blocked from rotating due to engagement of hook 18*a* with provisional stopper protrusion 15*h*, stopper protrusion 15*d* of coupling plate 15 is caught in the rear side of first side plate 17 functioning as a stopper, and moreover second flat section 15*b* enters inside second side plate 18, constrained from moving outward, and therefore first side plate 17 securely holds coupling plate 15 preventing coupling plate 15 from coming off.

When coupling plate 15 is stopped at the provisional stopping position shown in FIG. 6B, in order to prevent coupling plate 15 from rotating in the reverse direction from that position, it is desirable to elastically press second flat section 15*b* against second side plate 18 or adopt a configuration that hook 18*a* is pushed against guide plane 15*g* of coupling plate 15.

In FIG. 7, on the side opposite to the side to which coupling plate 15 of first part 2 is attached are side plates 23 and 24. Axis supporting section 25 is attached to side plate 23, supporting axis 5*a* of photosensitive drum 5.

Figure 10:
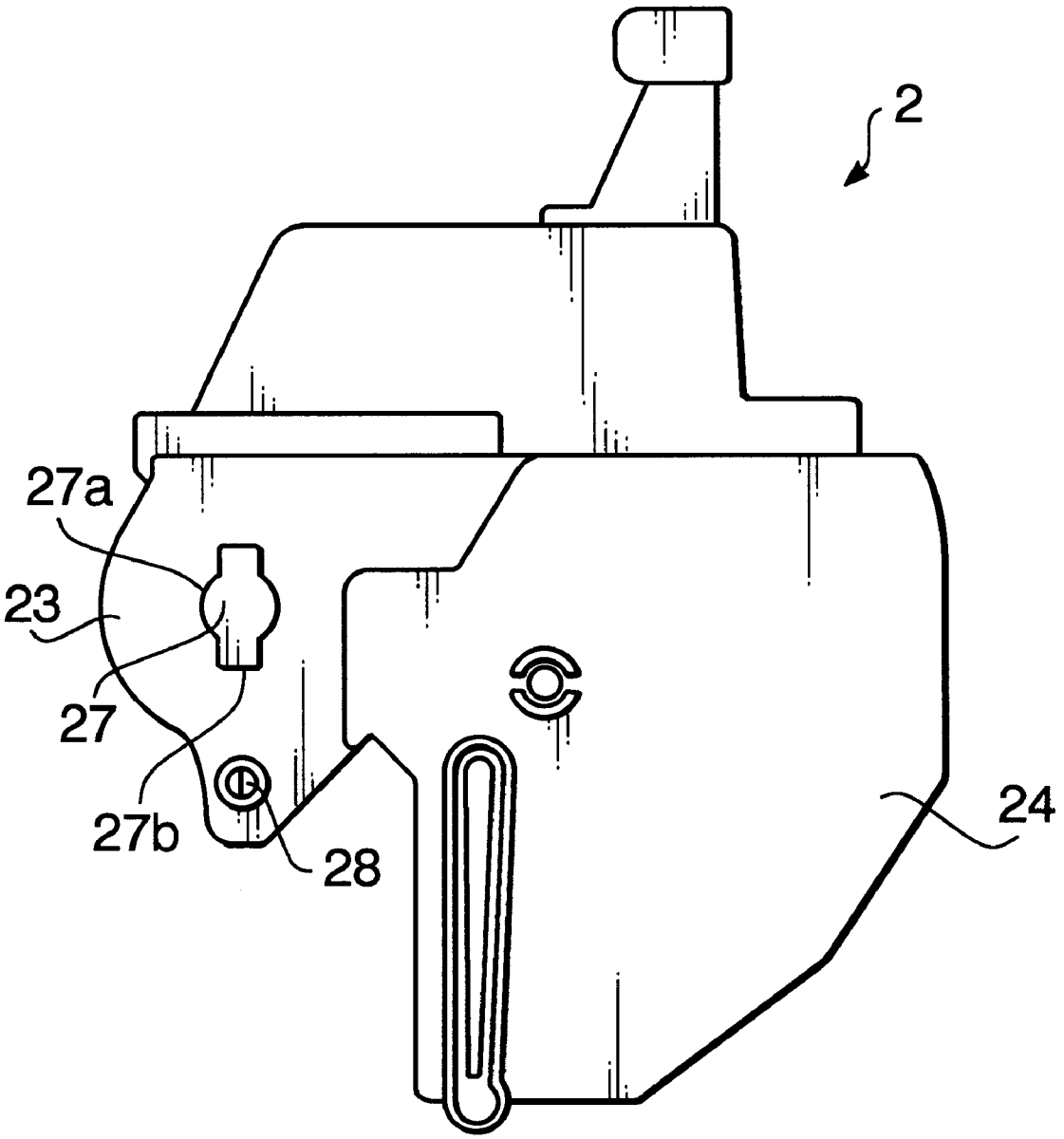
FIG. 10 is an outlined side view of the side opposite to the side of the first part shown in FIG. 5.

The structure of supporting photosensitive drum 6 by this axis supporting section 25 is explained below. FIGS. 9A–9E show this axis supporting section 25, FIG. 10 is an outline side view showing side plates 23 and 24 of first part 2 and FIGS. 11A and 1B are side views showing first part 2 with axis supporting section 25 attached and rotated.

Axis supporting section 25 has a solid structure made of resin, etc. and comprises flat section 25*a* and axis supporting section 25*b* provided perpendicular thereto, etc. This axis supporting section 25*b* has a cylindrical form and is provided with stopper protrusion 25*d* on the circumferential plane of its end and axis supporting hole 25*e* to support axis 5*a* of photosensitive drum inserted at the center. Furthermore, flat section 25*a* is also provided with hole 25*f* to stop rotation.

On the other hand, through hole 27 is formed in side plate 23 to attach axis supporting section 25. This through hole 27 is provided with circular section 27*a* to pass the cylindrical section of axis supporting section 25*b* of axis supporting plate 25 and groove 27*b* to pass stopper protrusion 25*d*. A pin 28 is provided under through hole 27 of side plate 23. Pin 28 can be engaged with hole 25*f* of axis supporting plate 25.

Figure 11B:
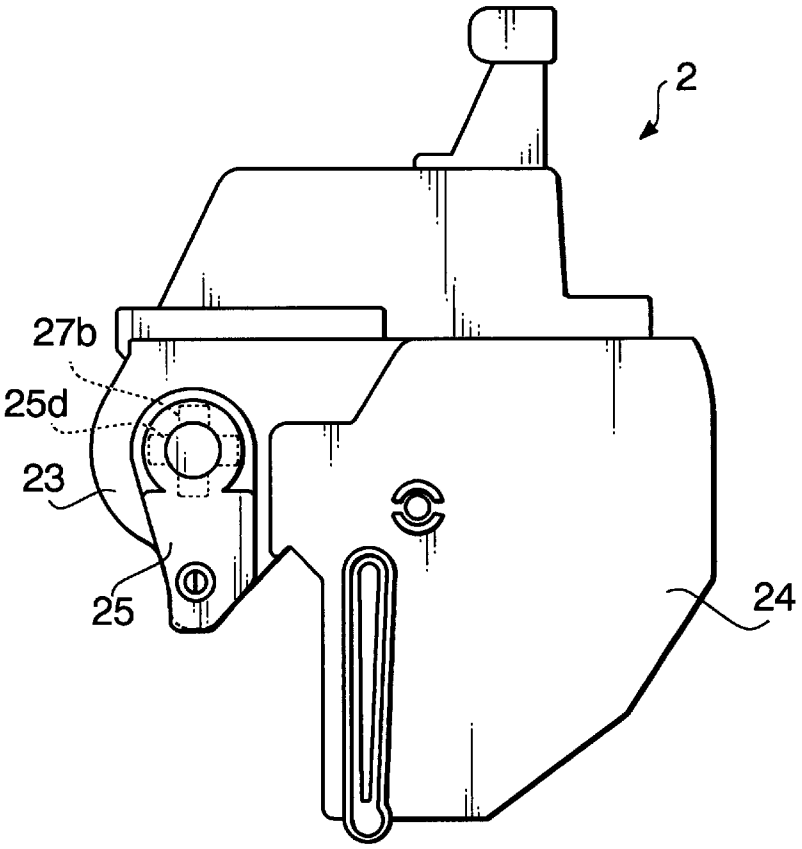
FIG. 11B is an outlined side view showing the axis supporting plate rotated to the final position.
Figure 11A:
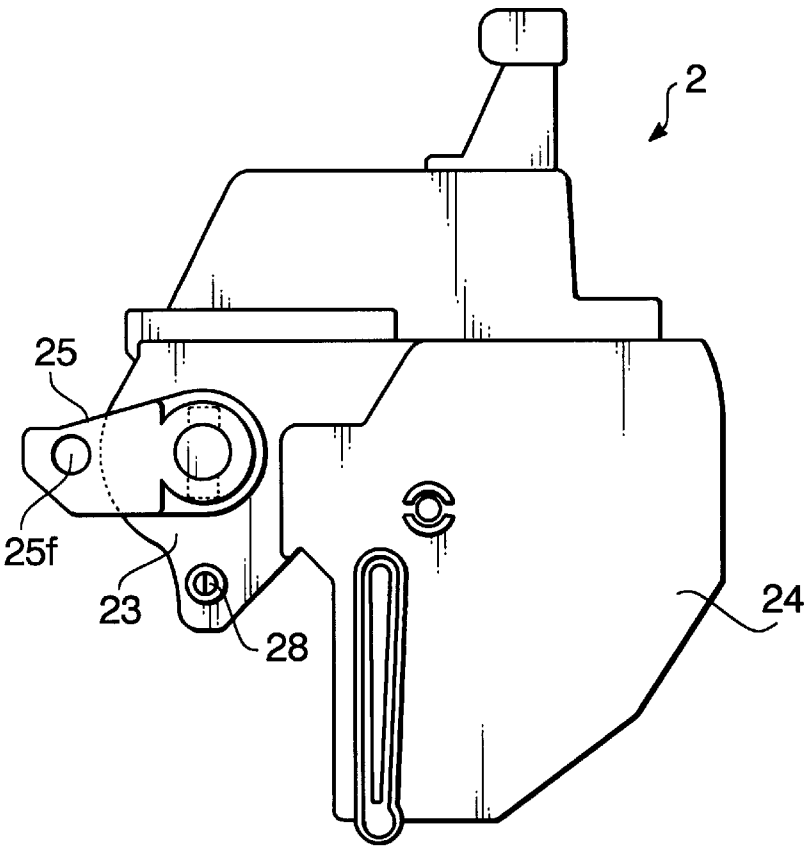
FIG. 11A is an outlined side view showing the axis supporting plate attached to the side wall.

Therefore, as shown in FIG. 11A, when axis supporting plate 25 is placed at a rotation angle with respect to through hole 27 so that stopper protrusion 25*d* fits in groove 27*b*, axis supporting section 25*b* can be inserted from the outer plane of side plate 23. After the insertion, when axis supporting plate 25 is rotated up to the position shown in FIG. 11B, stopper protrusion 25*d* is caught behind side plate 23, preventing it from coming off. Furthermore, pin 28 engages with hole 25*f*, restraining axis supporting plate 25 from rotating.

In FIG. 2, FIG. 3 and FIG. 7, second part 3, which is coupled with first part 2, is formed in such a size that second part 3 can enter between side plates 18 and 24 on both sides of first part 2. The end of axis 9*a* of magnet roller 9 attached to second part 3 is designed to have a length that can be supported by second support section 15*f* (see FIG. 4) formed on second flat section 15*b* of coupling plate 15 attached to first part 2.

Then, the assembly operation of toner cartridge 1 in the configuration above is explained. When photosensitive drum 5 is incorporated in first part 2, photosensitive drum 5 is placed between side plates 17 and 23 on both sides, first support section 15*c* of coupling plate 15 and axis supporting section 25*b* of axis supporting plate 25 are inserted from through holes 19 and 27 formed on side plates 17 and 23 to support axis 5*a* of photosensitive drum 5.

Then, axis supporting plate 25 is rotated up to the position shown in FIG. 11B and fixed to prevent it from coming off. Furthermore, coupling plate 15 is rotated up to the position shown in FIG. 6B and the rotation is temporarily stopped at the position where hook 18*a* collides with provisional stopper protrusion 15*h*. This prevents coupling plate 15 from coming off from side plate 17, and therefore photosensitive drum 5 is securely supported by first part 2 allowing first part 2 to be handled for assembly, etc. without trouble in this state.

Figure 8C:
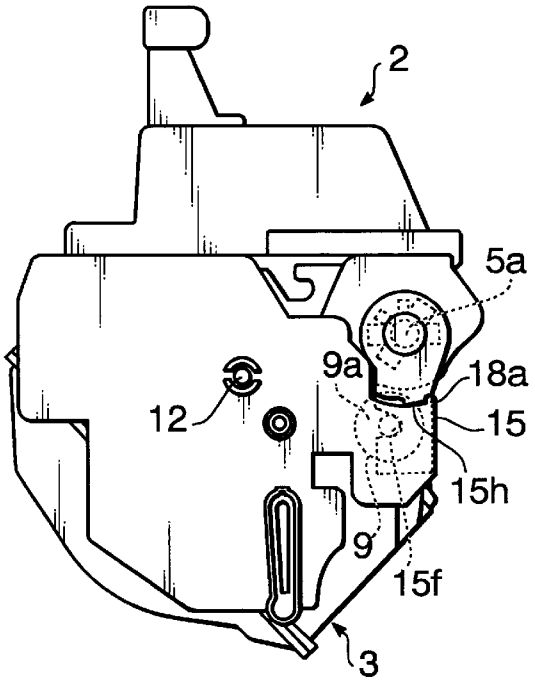
FIG. 8C is an outlined side view showing the second part set in the first part with the coupling plate coupling the two parts.
Figure 8B:
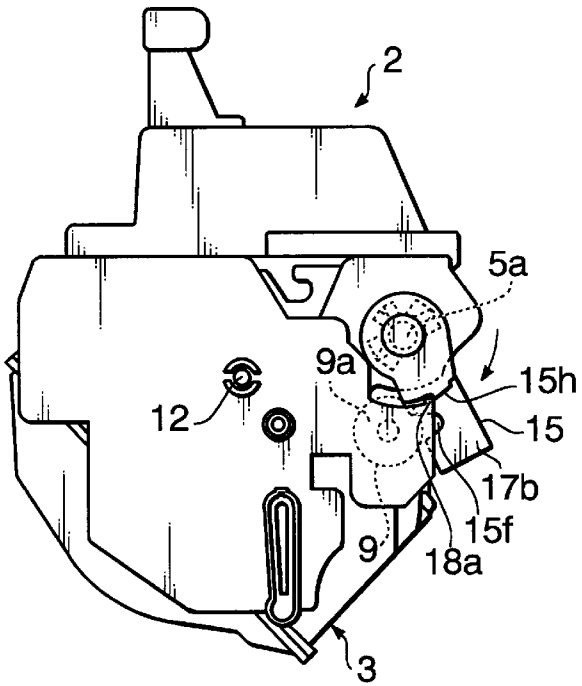
FIG. 8B is an outlined side view showing the second part set in the first part.
Figure 8A:
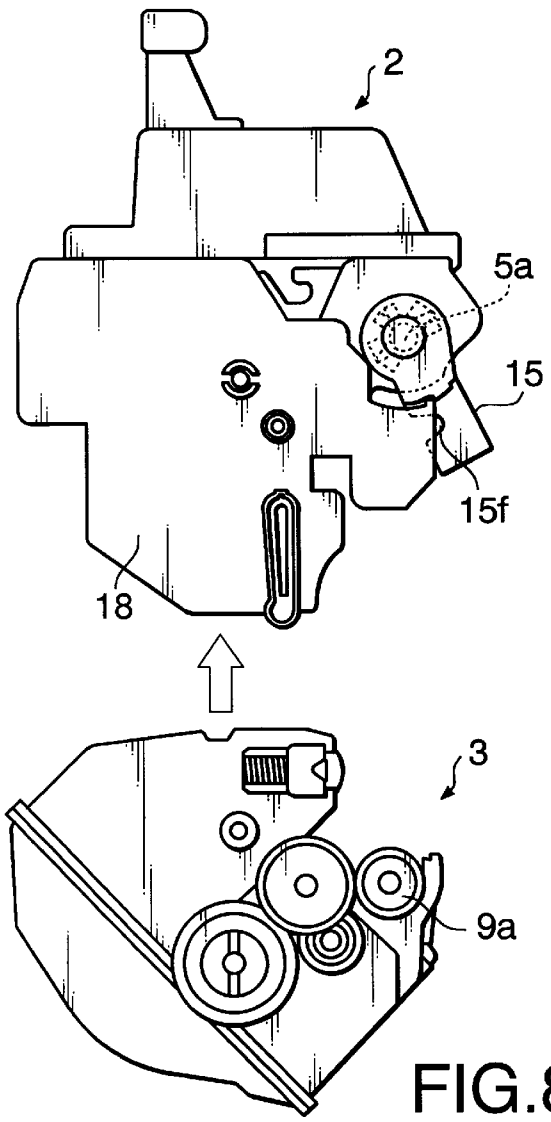
FIG. 8A is an outlined side view showing the first part before the second part is set.
Figure 9A:
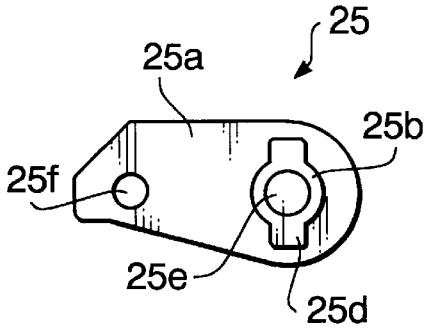
FIG. 9A is a floor plan showing an axis supporting plate that supports one axis of the photosensitive drum.
Figure 9B:
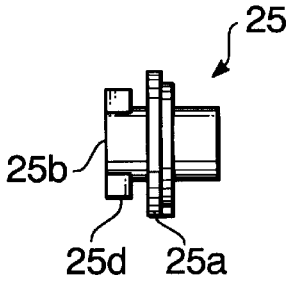
FIG. 9B is an end face view showing the axis supporting plate that supports one axis of the photosensitive drum.
Figure 9C:
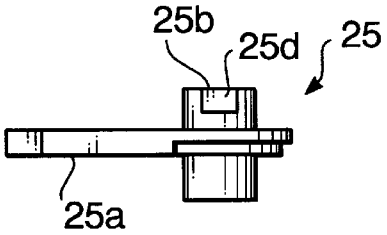
FIG. 9C is a side view showing the axis supporting plate that supports one axis of the photosensitive drum.
Figure 9D:
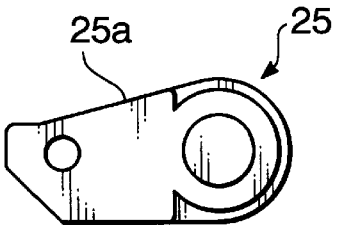
FIG. 9D is a floor plan of the axis supporting plate that supports one axis of the photosensitive drum.
Figure 9E:
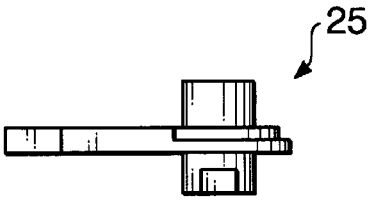
FIG. 9E is a side view showing the axis supporting plate that supports one axis of the photosensitive drum.

On the other hand, necessary parts are assembled into second part 3 apart from first part 2. When assembly is completed, as shown in FIG. 8A, second part 3 is inserted between side plates 18 and 24 (see FIG. 7) on both sides of first part 2 and both parts are coupled with pins 12 as shown in FIG. 8B.

Then, second part 3 is rotated and moved up to a position where magnet roller 9 comes to a predetermined distance from photosensitive drum 5 and in this state coupling plate 15 is pushed toward axis 9*a* of magnet roller 9. As shown in FIG. 8C, this allows provisional stopper protrusion 15*h* to go in beyond hook 18*a* and second support section 15*f* of coupling plate 15 to engage with axis 9*a* of magnet roller 9 and support axis 9*a*. This fixes first part 2 and second part 3 preventing them from rotating and maintains a predetermined distance between photosensitive drum 5 and magnet roller 9. Furthermore, the rear edge of provisional stopper protrusion 15*h* of coupling plate 15 is hooked at hook 18*a*, which fixes coupling plate 15 preventing it from rotating.

This completes the assembly operation of toner cartridge 1. This toner cartridge 1 is then incorporated in the recording apparatus. During this assembly operation or recording operation, photosensitive drum 5 and magnet roller 9 are always held by coupling plate in a predetermined distance, which allows optimal recording.

In the embodiment above, coupling plate 15 is placed on the gear side of toner cartridge 1. However, the present invention is not limited to this configuration, but coupling plate 15 and axis supporting plate 25 can also be switched round. Moreover, coupling plates 15 can also be placed on both sides of toner cartridge 1.

It is desirable to mount the toner cartridge explained above in a recording apparatus (printer or copier). This recording apparatus comprises a paper feeding mechanism that feeds paper on which an image is formed to a transport path, transfer mechanism that transfers an image (toner) formed on the photosensitive drum to paper and transport mechanism that carries the supplied paper to the transfer mechanism and discharges the paper that the transfer mechanism transferred the image through the transport path.

Furthermore, the toner cartridge explained above can also be used for a facsimile apparatus.

The present invention is not limited to the above described embodiments, and various variations and modifications may be possible without departing from the scope of the present invention.

This application is based on the Japanese Patent Application No.HEI11-103608 filed on Apr. 12, 1999, entire content of which is expressly incorporated by reference herein.

What is claimed is:

1. A toner cartridge, comprising:

a first part having a photosensitive drum that retains an electrostatic latent image to be developed;

a second part having a magnet roller that supplies toner from a toner hopper to said photosensitive drum, said second part being coupled with said first part;

a distance maintaining part having a side wall mounting section, a first support section and a second support section, said distance maintaining part maintaining a fixed predetermined distance between said photosensitive drum and said magnet roller, said side wall mounting section being removably mounted to a wall of said toner cartridge, said first support section supporting an axis of said photosensitive drum, and said second support section supporting an axis of said magnet roller.

2. The toner cartridge according to claim 1, wherein a distance between said first support section and said second support section nonresiliently defines said predetermined distance between said photosensitive drum and said magnet roller.

3. The toner cartridge according to claim 1, wherein said distance maintaining part comprises a resin member.

4. The toner cartridge according to claim 1, wherein said distance maintaining part is provided at each side of said toner cartridge.

5. A recording apparatus comprising:

the toner cartridge according to claim 1;

a transfer mechanism that transfers toner from said photosensitive drum to a medium;

a medium feeding mechanism that feeds a medium; and a transport mechanism that passes the medium fed through said transfer mechanism and discharges the medium.

6. A toner cartridge, comprising;

a first part having a photosensitive drum that retains an electrostatic latent image to be developed, a second part having a magnet roller that supplies toner from a toner hopper to said photosensitive drum, a distance maintaining part having a side wall mounting section for being removably mounted to a wall of said toner cartridge, said distance maintaining part supporting an axis of said photosensitive drum and an axis of said magnet roller to maintain a predetermined distance between said photosensitive drum and said magnet roller.

7. A recording apparatus comprising;

the toner cartridge according to claim 6;

a transfer mechanism that transfers toner from said photosensitive drum to a medium;

a medium feeding mechanism that feeds the medium; and a transport mechanism that passes the fed medium through said transfer mechanism and discharges the medium.

8. A toner cartridge, comprising:

a first part having a photosensitive drum that retains an electrostatic latent image to be developed;

a second part having a magnet roller that supplies toner in a toner hopper to said photosensitive drum;

a distance maintaining part having a first support section and a second support section, and maintaining a required distance between said photosensitive drum and said magnet roller, said first support section supporting an axis of said photosensitive drum, and said second support section supporting an axis of said magnet roller;

wherein said first support section comprises a structure received in a through hole formed in a side plate of said first part and said second support section is engaged with the axis of said magnet roller by rotation of said distance maintaining part in a first direction with said structure received in said through hole.

9. The toner cartridge according to claim 8, wherein said second part is coupled with said first part in a pivotable manner at a position spaced from an axis of said photosensitive drum and from an axis of said magnet roller.

10. The toner cartridge according to claim 8, wherein said first part comprises a stopper mechanism that prevents said distance maintaining part from rotating in a second direction opposite said first direction after said distance maintaining part has rotated to a position where said second support section engages with the axis of said magnet roller.

11. The toner cartridge according to claim 8, wherein said second support section comprises a groove in which the axis of said magnet roller is received when said distance maintaining part is rotated with said structure received in said through hole.

12. A toner cartridge, comprising:

a first part having a photosensitive drum that retains an electrostatic latent image to be developed;

a second part having a magnet roller that supplies toner in a toner hopper to said photosensitive drum;

a distance maintaining part having a first support section and a second support section, said distance maintaining part maintaining a predetermined distance between said photosensitive drum and magnet roller, said first support section supporting an axis of said photosensitive drum, and said second support section supporting an axis of said magnet roller;

wherein said first support section has a structure that is insertable into a through hole formed in a side plate of said first part only at a predetermined position, and said first support section is prevented from being removed from said through hole if the first support section moves from said predetermined position;

said second support section engages with the axis of said magnet roller by rotation of said distance maintaining part with said first support section inserted in said through hole; and said first part further comprising a stopping mechanism that temporarily stops the movement of said distance maintaining part prior to allowing said second support section to engage with the axis of said magnet roller.

13. The toner cartridge according to claim 12, wherein said through hole has a non-circular shape comprising a circular central opening and a plurality of sections extending from said circular central opening;

said first support section having a portion that protrudes in direction perpendicular to a plane of said distance maintaining part;

said portion having a cylindrical member having the same diameter as the circular central opening;

an axis supporting hole formed at the center of said cylindrical member, which receives one end of the axis of said photosensitive drum; and an extending section formed on a portion of an end of said cylindrical member having a shape corresponding to a shape of an extending section of said through hole.

14. The toner cartridge according to claim 12, said stopping mechanism comprising:

a guide surface formed on said first support section;

a stopping protrusion formed on said guide surface;

a sliding surface formed on said side plate on which said guide surface of said first support section slides; and a protrusion formed at the end of said sliding surface that contacts said stopping protrusion.

* * * * *

UNITED STATES PATENT AND TRADEMARK OFFICE

CERTIFICATE OF CORRECTION

PATENT NO. : 6,226,477 B1
DATED : May 1, 2001
INVENTOR(S) : E. Kurosawa et al.

It is certified that error appears in the above-identified patent and that said Letters Patent is hereby corrected as shown below:

Title page,
Item [73], Assignee, "Communications" should be -- Communication --.

Item [57], ABSTRACT, line 4, "seconds" should be -- second --.

Signed and Sealed this

Twenty-eighth Day of May, 2002

*Attest:*

*Attesting Officer*

JAMES E. ROGAN
*Director of the United States Patent and Trademark Office*